US006106306A

United States Patent [19]

Koga et al.

[11] Patent Number: 6,106,306

[45] Date of Patent: Aug. 22, 2000

[54] ELECTRICAL CONNECTOR HOUSING HAVING PROJECTING PARTS WITH REDUCED SIZE FITTING GAP DIMENSIONS

[75] Inventors: Masahiro Koga; Yoshihiko Kodaira, both of Kawasaki, Japan

[73] Assignee: Framatome Connectors International, Courbevoie, France

[21] Appl. No.: 09/155,035

[22] PCT Filed: Mar. 19, 1997

[86] PCT No.: PCT/JP97/00900

§ 371 Date: Nov. 2, 1998

§ 102(e) Date: Nov. 2, 1998

[87] PCT Pub. No.: WO97/35366

PCT Pub. Date: Sep. 25, 1997

[30] Foreign Application Priority Data

Mar. 21, 1996 [JP] Japan ..... 8-064954

[51] Int. Cl.[7] ..... H01R 9/09

[52] U.S. Cl. ..... 439/74; 439/660

[58] Field of Search ..... 439/74, 660, 680, 439/931, 83, 592, 76, 64, 78–81

[56] References Cited

U.S. PATENT DOCUMENTS

| | | | |
|---|---|---|---|
| 3,644,873 | 2/1972 | Dalton et al. | 439/74 |
| 3,850,497 | 11/1974 | Krumreich et al. | 439/74 |
| 5,013,264 | 5/1991 | Tondreault | 439/636 |
| 5,199,884 | 4/1993 | Kaufman et al. | 439/74 |
| 5,626,483 | 5/1997 | Naitoh | 439/74 |
| 5,931,689 | 8/1999 | Patel | 439/346 |

FOREIGN PATENT DOCUMENTS

| | | |
|---|---|---|
| 60-76884 | 5/1985 | Japan . |
| 61-141787 | 9/1986 | Japan . |
| 3-126389 | 12/1991 | Japan . |
| 4-289679 | 10/1992 | Japan . |
| 8-31528 | 2/1996 | Japan . |

OTHER PUBLICATIONS

PCT International Search Report JP97/00900, Mar. 19, 1997.

*Primary Examiner*—Khiem Nguyen
*Assistant Examiner*—Son V. Nguyen
*Attorney, Agent, or Firm*—Perman & Green, LLP

[57] ABSTRACT

A connector 21 comprises a receptacle housing 26 which is affixed to one wiring element 22 and a plug housing 27 which is affixed to another wiring element 24; projecting parts 26*c* which project in the direction of the other housing 27 in the vicinity of the floor surface 26*b* of the receptacle housing 26 during the engagement of the housings 26 and 27 are provided in one or the other of the inner surface of the side walls 26*a* of the receptacle housing 26 and the side surfaces 27*a* of plug housing 27, and the dimensions c1 of a fitting gap between the two housings 26 and 27 at these projecting parts 26*b* is set so as to be smaller than the dimensions c2 of a fitting gap between the housings 26 and 27 at parts other than the projecting parts 26*c*.

13 Claims, 12 Drawing Sheets

54
28
54b
28
54a
51
54c
52a
52c
24
52b
6
52c
53
53
52
22

PRIOR ART

ELECTRICAL CONNECTOR HOUSING HAVING PROJECTING PARTS WITH REDUCED SIZE FITTING GAP DIMENSIONS

FIELD OF THE INVENTION

The present invention relates to a connector which is capable of coupling two wiring elements with a gap therebetween, in the manner of a stacking connector which couples a plurality of printed wiring elements disposed in a layered structure, and simultaneously electrically connects wiring provided on the wiring elements.

BACKGROUND ART

Commonly, as shown in FIGS. 19 and 20, such a stacking connector 1 has a receptacle connector 3 affixed to a printed circuit board 2, and plug connector 5 affixed to another printed circuit board 4, and by engaging these, the connector simultaneously conducts the positioning of printed circuit boards 2 and 4 and the electrical connection of the wiring on printed circuit boards 2 and 4.

That is to say, receptacle connector 3 is provided with a plurality of contacts 6 which are connected to the wiring of one printed circuit board 2, and a receptacle housing 7 which is in the shape of a box with a floor having a rectangular shape in horizontal cross section, which accepts these contacts 6; plug connector 5 is provided with a plurality of contacts 8 which connect with the wiring of the other printed circuit board 4, and a plug housing 9 which has the shape of a rectangular parallelopiped block and holds the contacts 8 in a unitary manner.

That is to say, when a receptacle connector 3 and plug connector 5 having such a structure are connected, the plug housing 9 is inserted within the receptacle housing 7, and thereby the two are engaged with a gap having a constant fit therebetween, and the printed circuit boards 2 and 4 are positioned with respect to one another with an accuracy depending on the dimensions of the fitted gap.

Now that portable electronic apparatuses such as portable phones and the like have come to be widely used as a result of developments in the miniaturization and reduction in weight of electronic products, in concert with a miniaturization and decrease in weight in the printed circuit boards 2 and 4 installed within such electronic apparatuses, it is also necessary to reduce the size and weight of the connectors 1 connecting these printed circuit boards 2 and 4. In order to reduce the size and weight of such connectors 1, light weight materials are employed, and a reduction in size of contacts 6 and 8 requires that the walls of housings 7 and 9, and in particular, receptacle housing 7, be made thinner, while maintaining the minimum strength required for the positioning and affixing of printed circuit boards 2 and 4.

However, as a result of the reduction in size and weight, there are problems in that the strength of the receptacle housing 7 with respect to impact is reduced when the walls thereof are made thinner. In particular, in portable electronic apparatuses such as portable telephones and the like, there is a high frequency of such impacts during use as a result of droppage and the like, and the receptacle housing 7 may break as a result of the repetition of such impacts.

In particular, as shown by arrow A in FIG. 20, when an impact force is applied in the longitudinal direction to the receptacle housing 7, cracks C are likely to be produced between the side walls 7*a* and opening end 7*b* of the receptacle housing 7 disposed at the ends in the longitudinal direction. The reason for this is that the side walls 7*c* of the receptacle housing 7 which run in the longitudinal direction receive the impact force from the plug housing over a broad surface area, and in addition the points of contact between connectors 6 and 8 are commonly provided in the transverse direction of receptacle housing 7, so that this has the effect of ameliorating the impact force as a result of the elastic deformation of contacts 6 and 8, while the side walls 7*a* of the receptacle housing 7 disposed at the ends in the longitudinal direction do not have such an amelioration effect, and directly receive the impact force over a narrow surface area.

Furthermore, the reason that cracks C are produced in the corner part between the side walls 7*a* and the opening end 7*b* of the receptacle housing 7 is that, because the rigidity of the thin side walls 7*a* is low, the tensile force operating within the receptacle housing 7 as a result of the impact force is excessive.

In order to avoid such problems, attempts have been made to increase the thickness of the side walls 7*a* at both longitudinal ends of the receptacle housing 7, and to adopt a rounded shape in order to avoid the concentration of stress at the corner part of side walls 7*a* of receptacle housing 7; however, in all these cases, receptacle housing 7 has been too large, and this is not desirable.

On the other hand, in the example shown in FIG. 21, stacking connector 10 is disposed between two printed circuit boards 11 and 13, and comprises a plug connector 12, in which a plurality of socket contacts 17 which connect to a plurality of wirings (not depicted in the figure) provided in printed circuit board 11, are housed within a plug housing 15, and a receptacle connector 14, in which a plurality of pin contacts 18, which are connected with a plurality of wirings (not depicted in the figure) provided on the other printed circuit board 13, are housed within a receptacle housing 15. There are many cases in which the stacking height of printed circuit boards 11 and 13 is determined by the height of the electronic parts or the like which are installed on printed circuit boards 11 and 13 are installed. That is to say, as the height of the part which installed on printed circuit board 11 is installed increases, it is necessary to increase the stacking height in order to avoid interference between this part and the other printed circuit board 13, or with electronic parts or the like which are installed on the other printed circuit board 13.

In this case, it is necessary to increase the height of connector 10 in accordance with the stacking height of printed circuit boards 11 and 13; however, conventionally, as shown for example in FIG. 21, this need was met by increasing the height of housing 16 and increasing the length of the contacts 18 within housing 16.

However, when the length of contacts 18 was increased, as shown in FIG. 21, because there was a lengthening of the region in which neighboring contacts 18 were disposed in opposition to one another, there were problems in that the floating capacity generated between contacts 18 was large, and signals transmitted through one contact 18 were induced into another contact 18, so that the so-called cross-talk noise was large.

In particular, in concert with the advances in digital technology in recent years, as a result of an increase in the clock frequency of IC parts and the like, the effects of cross-talk noise have become striking in the state in which signal transmission is accomplished at high speeds.

The characteristics of the floating capacity which is the source of this cross-talk noise are such that the floating capacity becomes larger as the opposed surface areas of the neighboring contact 18 increase, and becomes larger as the gap between the contact 18 becomes smaller.

Accordingly, a widening of the gap between contacts 18, or alternatively, placing electronic shielding between contacts 18, have been considered as methods for reducing such cross-talk noise. However, when the gap between contacts 18 is widened, the dimensions of connector 10 are increased, and furthermore, when electronic shielding is placed between contacts 18, the structure of connector 10 becomes more complex, so that product cost increases.

Furthermore, a reduction in size of the opposed surface areas of the neighboring contacts 18 is also effective as a method of reducing the floating capacity; however, there is a limit to the reduction in thickness of contacts 18 which may be achieved both from the point of view of manufacturing technology and structural strength. For example, in the case of contacts 18 having an overall length of 15 mm, the thickness thereof has a lower limit within a range of 0.1 mm–0.15 mm.

SUMMARY OF THE INVENTION

The present invention was designed in light of the above circumstances; it has as one object thereof to provide a connector which, although reduced in size and weight, is difficult to break even if subjected to impact. Furthermore, the present invention has as an object thereof to provide a connector which is capable of effectively suppressing the generation of cross-talk noise even in cases requiring a predetermined length, such as cases in which the stacking height is large.

In order to attain the first object described above, the present invention proposes a connector which is disposed between two wiring elements arranged with a gap therebetween, and which engages with both of these elements, whereby the wiring elements are coupled in a positioned state, and a plurality of corresponding wirings provided on the wiring elements are electrically connected; wherein are provided a receptacle housing having a shape of a box with a floor, which is affixed to one of the wiring elements, and which houses a plurality of contacts which are connected to the wirings of the wiring element, and a plug housing, which is affixed to the other wiring element, houses a plurality of contacts which are connected to the wirings of this wiring element, and which engages within the receptacle housing during connection; wherein projecting parts are provided on the inner surface of the receptacle housing or on the outer surface of the plug housing, which project in the direction of the other housing at the floor part of the receptacle housing or in the vicinity thereof when the two housings are engaged, and the fitting gap dimensions of the two housings at the projecting parts are set so as to be smaller than the fitting gap dimensions of the two housings at parts other than the projecting parts.

Furthermore, in the connector described above, the projecting parts may be provided in the side inner surface of the receptacle housing or in the side surface of the plug housing; in such a case, groove-shaped concave parts which engages the projecting parts may be formed in the other housing which opposes the projecting parts, and the depth dimension of these concave parts may be set so as to be smaller than the height dimension of the projecting parts.

Furthermore, in the connector described above, the setting of the fitting gap dimension between the concave parts and the projecting parts in the groove transverse direction of the groove shaped concave part so as to be smaller than the fitting gap dimension between the two housings disposed on both sides in the transverse direction of the groove is effective.

Furthermore, in the connector described above, the projecting parts may be provided in the floor surface of the receptacle housing or in the lead end surface of the plug housing, and concave parts which engage with the projecting part may be formed in the lead end surface of the plug housing or the floor surface of the receptacle housing opposed to the projecting parts.

Furthermore, the connector described above is not limited to the case in which it is affixed to the wiring elements, and it may simply be provided with a receptacle housing and a plug housing which engages therewith, wherein projecting parts are provided in one or the other of the inner surface of the receptacle housing or the outer surface of the plug housing and project in the direction of the other housing at the floor part of the receptacle housing or the vicinity thereof when both housings are engaged, and the fitting gap dimension of both housings at these projecting parts is set so as to be smaller than the fitting gap dimension between both housings at parts other than the projecting parts.

Furthermore, in order to attain the second object stated above, the present invention proposes a connector which is disposed between two wiring elements disposed with a gap therebetween, which couples the two wiring elements in a positioned state and connects in a detachable manner a plurality of corresponding wirings provided on the wiring elements, wherein pin contacts or socket contacts which are mutually detachable are provided for each corresponding wiring on the two wiring elements, and a conductor formed with a leaf shape and affixed to a structural part is connected to one or the other of the pin contacts or the socket contacts so as to be adjacent thereto in the transverse direction and in contact therewith.

Furthermore, the structure may be such as to comprise a first connector, in which a plurality of pin contacts connected to the wiring of one wiring element are housed within a housing, and a second connector, in which a plurality of socket contacts connected to the wiring of the other wiring element are housed within a housing, where the structural part comprises any of the housings described above.

In the connector described above, the structural part to which the conductor is affixed may comprise a printed circuit board, a molded interconnection device (MID), or the like. Furthermore, this may also be constructed by applying a flexible printed circuit board to a freely selected structural part. Furthermore, the pin contacts may be formed by the conductor applied to the structural part.

BRIEF DESCRIPTION OF THE DIAGRAMS

DETAILED DESCRIPTION OF THE PREFERRED EMBODIMENTS

Hereinbelow, embodiments of the connector in accordance with the present invention will be explained with reference to FIGS. 1 through 3.

Figure 1:
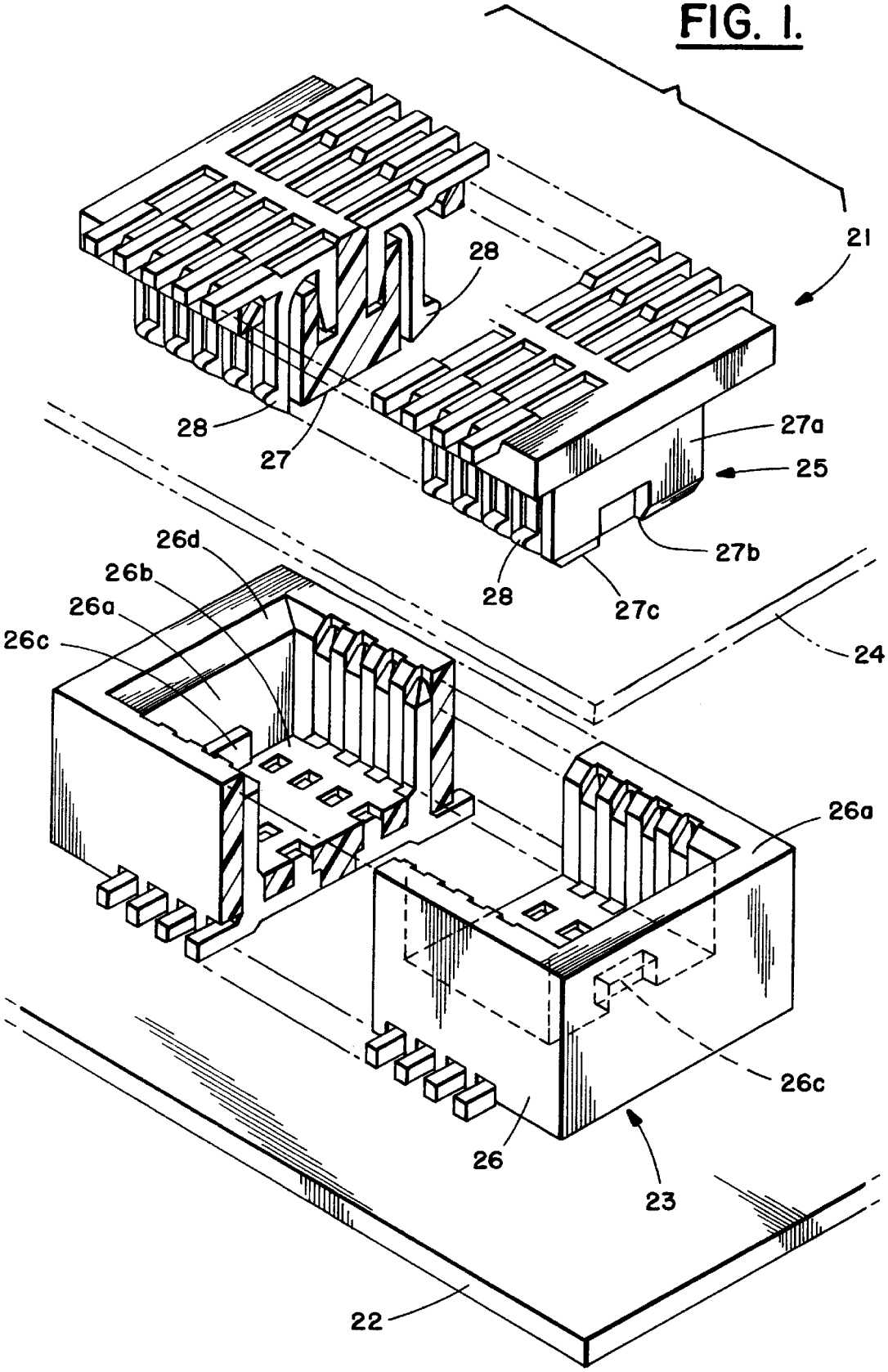
FIG. 1 is an angled view showing the essential parts of an embodiment of a connector in accordance with the present invention.

As shown in FIG. 1, the connector 21 in accordance with the present embodiment also comprises a receptacle connector 23 which is affixed to one printed circuit board 22 and a plug connector 25 which is affixed to another printed circuit board 24; the housing (receptacle housing) 26 of receptacle connector 23 is also formed with a shape of a box having a floor, and the housing (plug housing) 27 of plug connector 25 is also formed in a rectangular block shape, and these points are in common with those of the conventional connector 1.

However, the connector 21 in accordance with the present embodiment differs from the conventional connector 1 in the structure of housings 26 and 27.

The receptacle housing 26 of connector 21 of the present embodiment is provided with projecting parts 26*c*, which project into the interior of receptacle housing 26, at the inner surface of side walls 26*a*, positioned at the longitudinal ends of the housing, in the vicinity of the floor surface (floor part) 26*b*. These projecting parts 26*c* are disposed at a central position in the transverse direction of the side walls 26*a*, and are formed with a step shape having a constant width and a constant height.

Plug housing 27 is provided with concave parts 27*b* which are formed with a step shape having a constant width and a constant depth at a transverse central position in the lead end of both end surfaces 27*a* in the longitudinal direction. The width of these concave parts 27*b* is formed so as to be slightly larger than the width of the projecting parts 26*c* of receptacle housing 26, while the depth thereof is formed so as to be slightly less than the height of the projecting parts 26*c*. These concave parts 27*b* may be provided so as to effectively take advantage of the space between the contacts 28 disposed in the transverse direction of plug housing 27.

Furthermore, the dimensions of the gap between the two projecting parts 26*c* disposed in the side walls 26*a* at the two ends in the longitudinal direction of receptacle housing 26 is formed so as to be slightly larger than that between the floor surfaces of the concave parts 27*b* of plug housing 27, so that plug housing 27 is inserted into receptacle housing 26 so as to form a constant fitting gap between plug housing 27 and receptacle housing 26.

Furthermore, references 26*d* and 27*c* in the figure indicate chamfered parts which serve to facilitate the engagement of plug housing 27 within receptacle housing 26.

The function of the connector 21 of the present embodiment having such a structure is explained hereinbelow.

In order to connect the wiring of two printed circuit boards 22 and 24 to one another using the connector 21 of the present embodiment, the printed circuit board 22 to which the receptacle connector 23 is affixed and the printed circuit board 24 to which the plug connector 25 is affixed are brought into close proximity, and plug housing 27 is engaged within receptacle housing 26.

When this is done, plug housing 27 is guided within receptacle housing 26 by chamfered parts 26*d* and 27*c*, and plug housing 27 is inserted within receptacle housing 26 along the inner surfaces of side walls 26*a*. By means of this, the engagement operation depicted in FIG. 2 is completed. In this case, the projecting parts 26*c* provided on the inner surfaces of the side walls 26*a* of receptacle housing 26 are inserted within the concave parts 27*b* provided in the side surfaces 27*a* of plug housing 27.

Here, this results in the formation of constant fitting gaps c1 and c2 between the end surface of projecting part 26*c* and the floor surface of concave part 27*b*, and between the inner surface of side walls 26*a* of receptacle housing 26 and the side surfaces 27*a* of plug housing 27; since the depth of concave part 27*b* is formed so as to be smaller than the height of projecting part 26*c*, the fitting gap cl between the end surface of projecting part 26*c* and the floor surface of concave part 27*b* is the smallest.

Figure 2:
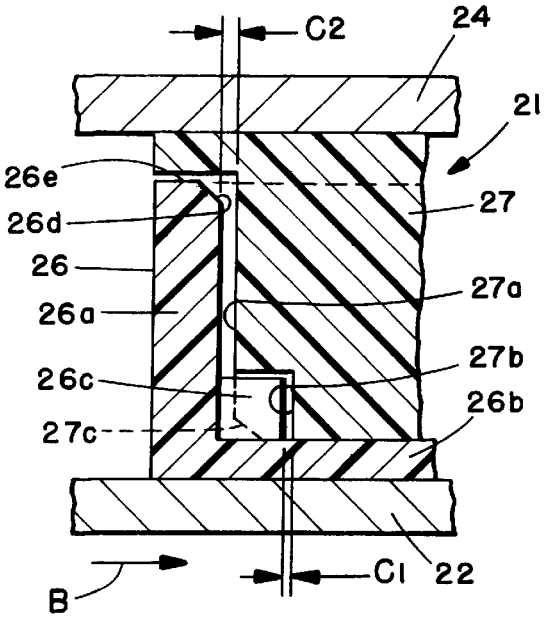
FIG. 2 is a vertical cross-sectional view showing a part of the connector of FIG. 1.

Accordingly, when an impact force resulting from droppage or the like operates in the direction shown by arrow B in FIG. 2, plug housing 27 moves within receptacle housing 26 in a direction opposite to that of arrow B as a result of the inertial force thereof.

Figure 3:
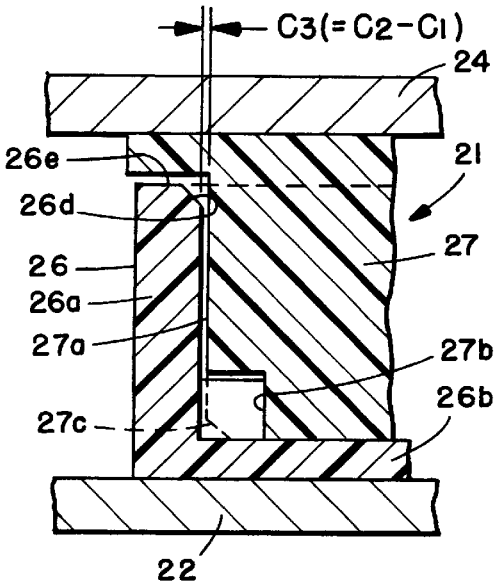
FIG. 3 is a vertical cross-sectional view identical to that of FIG. 2 showing the state in which an impact force operates on the connector of FIG. 1.

By means of this, as shown in FIG. 3, receptacle housing 26 and plug housing 27 come into contact at the end surface of projecting part 26*c* and the floor surface of concave part 27*b*, and the impact force is absorbed by the parts which are in contact.

In this case, projecting parts 26*c* are provided in the vicinity of the floor surface 26*b* separated from the opening end 26*e* within the side walls 26*a* of receptacle housing 26, and the side walls 26*a* in the vicinity of these projecting parts 26*c* are persistently supported by the side walls 26*a* and floor surface 26*b* at both ends in the transverse direction of the receptacle housing 26. Accordingly, the impact force absorbed from plug housing 27 can be sufficiently dispersed by these parts.

More over, as described above, the impact force applied to receptacle housing 26 by plug housing 27 is applied at a position of receptacle housing 26 separate from the opening end 26*e*, so that it is possible to avoid a direct application of impact force in the vicinity of opening end 26*e*.

As a result, the concentrated application of force in the vicinity of the opening end 26*e* which occurred in the conventional connector 1 can be avoided, and it is possible to reliably avoid the occurrence of problems such as the generation of cracks and the like at opening end 26*e*.

Furthermore, as described above, the concave parts 27*b* provided in the lead end of plug housing 27 can be formed in such a manner as to make effective use of the spaces between contacts 28 of plug housing 27, so that it is also possible to form the projecting parts 26*c* which engage therewith in such a manner as not to increase the dimensions of receptacle housing 26. Accordingly, this is effective in producing a impact-resistant connector 21 without increasing the size of connector 21.

In the above embodiment, projecting parts 26*c* are provided in the inner surface of side walls 26*a* of receptacle housing 26 in the vicinity of floor surface 26*b*, and concave parts 27*b* which engage with the projecting parts 26*c* are provided at corresponding positions in plug housing 27; however, if the spaces between rows of contacts 28 permit, these may be disposed in the opposite manner, that is to say, the projecting parts may be provided in the lead ends of plug housing 27, while concave parts having a groove shape which serve to guide the projecting parts as far as the floor surface 26*b* of receptacle housing 26 may be provided in the inner surfaces of the side walls 26*a* of receptacle housing 26.

Furthermore, in the embodiment described above, concave parts 27*b* which corresponded to projecting parts 26*c* were provided in plug housing 27; however, a projecting part having a height dimension c3 (=c2−c1) representing the difference between the dimension c1 of the fitting gap between the projecting parts 26*c* and the concave parts 27*b* described above and the dimension c2 of the fitting gap between the inner surface of the side wall 26*a* of the receptacle housing 26 and the side surface 27*a* of plug housing 27, may be provided in the vicinity of the floor surface 26*b* of receptacle housing 26 or in the lead end of the plug housing 27, and the concave parts 27*b* may be eliminated. Furthermore, even if projecting parts which touch one another are provided in both the receptacle housing 26 and the plug housing 27, it is possible to construct a impact resistant connector.

Figure 4:
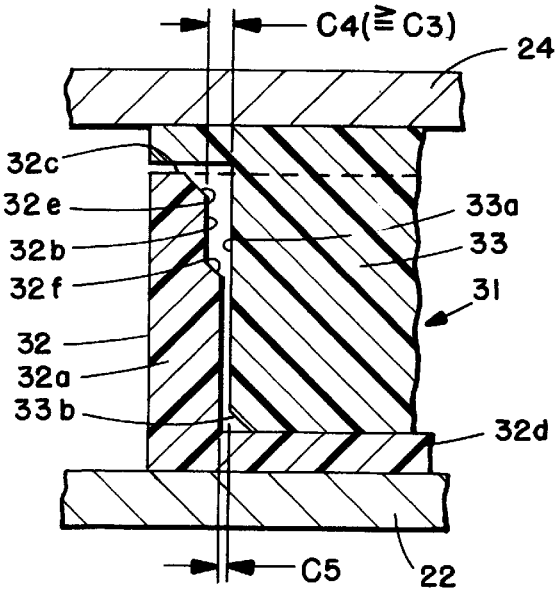
FIG. 4 is a vertical cross-sectional view showing a second embodiment of a connector in accordance with the present invention.

Next, a second embodiment of a connector in accordance with the present invention will be explained with reference to FIG. 4.

In connector 31 in accordance with the present embodiment, a step part 32*b* which is one step lower than the inner surface of the side wall 32*a* is formed in the inner surface of side walls 32*a* in the longitudinal direction of receptacle housing 32 to a position having a constant depth in the direction of floor surface 32*d* from opening end 32*c*. From another point of view, this step part 32*b* can be viewed as though the surface which is one step lower formed by step part 32*b* is the inner surface of the side walls of receptacle housing 32, and projecting parts which project within receptacle housing 32 over the entire length in the transverse direction thereof are provided. The side surfaces 33*a* of plug housing 33 are formed in a flat manner.

In the present embodiment, the step gap c4 between step part 32*b* and the inner surface of side walls 32*a* of receptacle housing 32 is formed so as to be equivalent to or greater than the difference c3 between the fitting gaps in the first embodiment. Furthermore, the dimensions c5 of the fitting gap between the inner surface of the side walls 32*a* of receptacle housing 32 and side surfaces 33*a* of the plug housing 33 are set so as to be equivalent to the dimensions c1 of the fitting gap between the projecting parts 26*c* and the concave parts 27*b* in the first embodiment described above.

Furthermore, chamfered parts 32*e*, 32*f*, and 33*b*, which serve to guide the engagement of housings 32 and 33, are formed in the opening end 32*c* of receptacle housing 32, and in the lead ends of step part 32*b* and plug housing 33.

In accordance with connector 31 in accordance with the present embodiment, when the position of plug housing 33 changes within receptacle housing 32 as a result of impact force resulting from droppage or the like, the side surfaces 33*a* of plug housing 33 come into contact with parts other than the inner surface of side walls 32*a* of receptacle housing 32 and step part 32*b*; that is to say, they come into contact only with parts in the vicinity of floor surface 32*d*. By means of this, the impact force from plug housing 33 is received by receptacle housing 32 only at those parts which are in contact, and in the same manner as in the first embodiment, it is thus possible to avoid a localized excessive concentration of stress at the opening part 32*c* of receptacle housing 32.

Moreover, in the connector 31 in accordance with the present embodiment, as a result of the formation of step parts 32*b*, gaps are formed between the housings 32 and 33 in the vicinity of opening end 32*c* of receptacle housing 32, so that even if the position of plug housing 33 moves downward, no harm will be caused to receptacle housing 32 by plug housing 33. Accordingly, it is possible to maintain the good condition of receptacle housing 32 even when attaching and detaching housings 32 and 33.

In the second embodiment described above, the inner surface of the side walls 32*a* of the receptacle housing 32 were made to project more than the other parts in the vicinity of the floor surface 32*d*, and the side surfaces 33*a* of the plug housing 33 opposing these were made flat; however, this may be done in the opposite manner, so that concave parts are provided on the base side of the side surfaces 33*a* of plug housing 33, while the inner surfaces of the side walls 32*a* of receptacle housing 32 are formed so as to be flat.

Furthermore, in the second embodiment described above, a step gap higher by one step may be formed in the base side of the side surfaces 33*a* of the plug housing 33, and the dimensions of the fitting gap with the receptacle housing 32 may be regulated.

Figure 5:
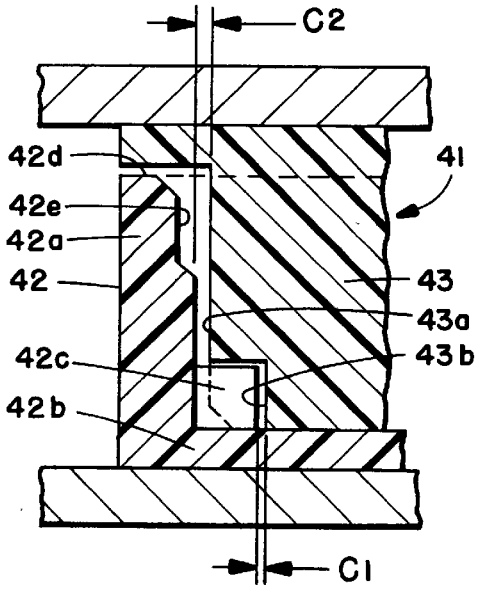
FIG. 5 is a vertical cross-sectional view showing a third embodiment of a connector in accordance with the present invention.

Furthermore, a third embodiment of a connector in accordance with the present invention will be explained with reference to FIG. 5.

Connector 41 in accordance with the present embodiment basically has a structure which represents a combination of the first and second embodiments.

That is to say, in the connector 41 in accordance with the present embodiment, projecting parts 42*c* which project to the interior of receptacle housing 32 are provided on the inner surface of side walls 42*a* at the longitudinal ends of receptacle housing 42 in the vicinity of floor surface 42*b*, and step parts 42*e* which are one step lower than the inner surfaces of side walls 42*a* are provided at the opening ends 42*d*. The plug housing is identical to that used in the first embodiment.

The connector 41 having such a structure has a combination of the characteristic features of connectors 21 and 31 of the first and second embodiments. That is to say, the impact force is received by the contact between the projecting parts 42*c* and the concave parts 43*b*, so that in the same manner as in connector 21 of the first embodiment, the receptacle housing 42 can be maintained in a good condition.

Furthermore, even in cases in which a collapse of the plug housing 43 is caused, contact between the side surfaces 43*a* of the plug housing 43 and the inner surfaces of the side walls 42*a* of the receptacle housing 42 can be avoided by the step parts 42*e*, so that in the same manner as in the second embodiment, the receptacle housing 42 may be maintained in good condition.

Furthermore, in addition to the above effects, the connector 41 in accordance with the present embodiment has the following effects.

For example, in cases in which an unforeseeably large impact force acts and projecting parts 42*c* are compressed, or in cases in which as a result of changes over time, projecting part s 42*c* break down, the side surfaces 43*a* of the plug housing 43 come into contact with inner surfaces of the side walls 42*a* of receptacle housing 42; however, even in such cases, step parts 42*e* are provided in the inner surfaces of the side walls 42*a* of receptacle housing 42, so that the impact force from the plug housing 43 is received only in the vicinity of the floor surface 42*b* in the receptacle housing 42, and it is possible to avoid the generation of cracks or the like in the vicinity of the opening end 42*d* of receptacle housing 42.

Next, a fourth embodiment of a connector in accordance with the present invention will be explained with references to FIGS. 6 through 8.

Figure 6:
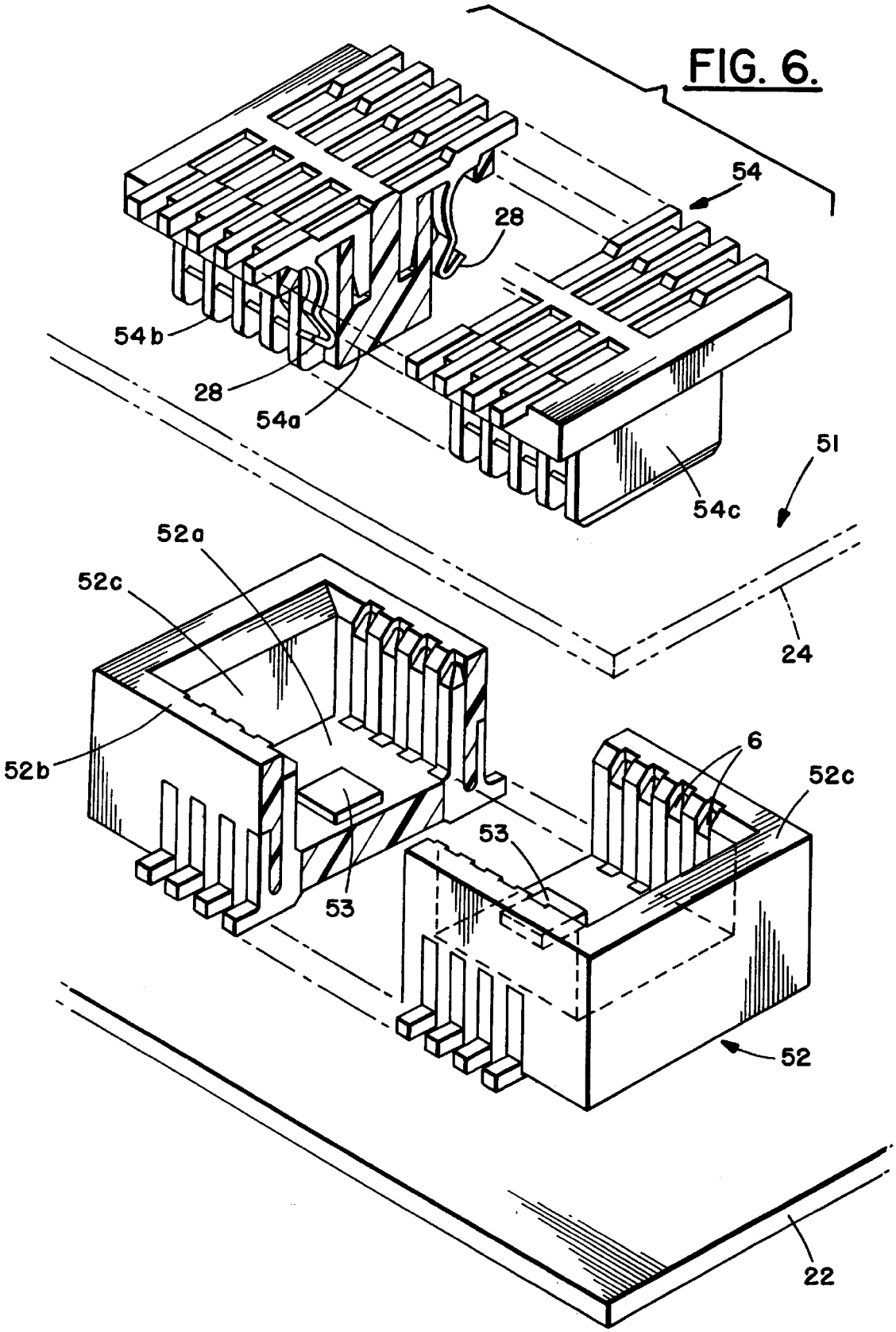
FIG. 6 is an angled view showing the essential parts of a fourth embodiment of a connector in accordance with the present invention.
Figure 8A:
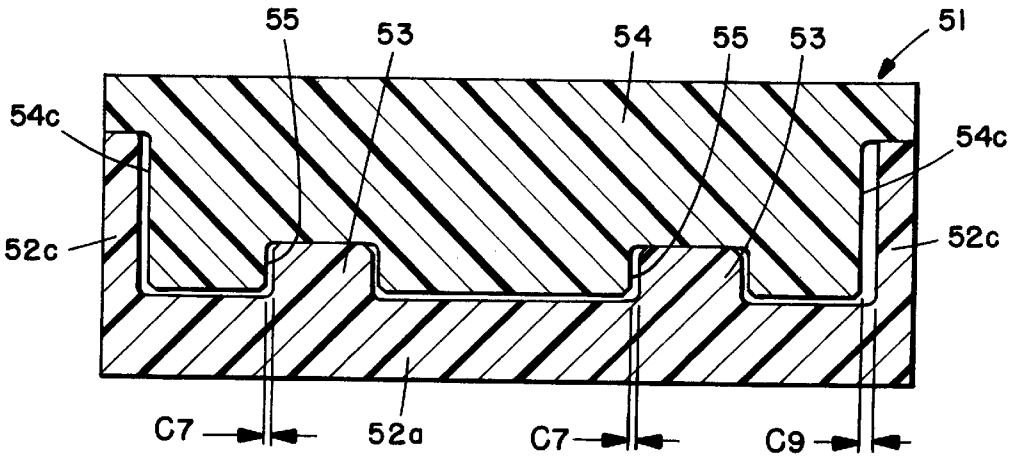
FIGS. 8A and 8B are vertical cross-sectional views of the connector of FIG. 6 taken along the direction of the pitch of the contacts.
Figure 8B:
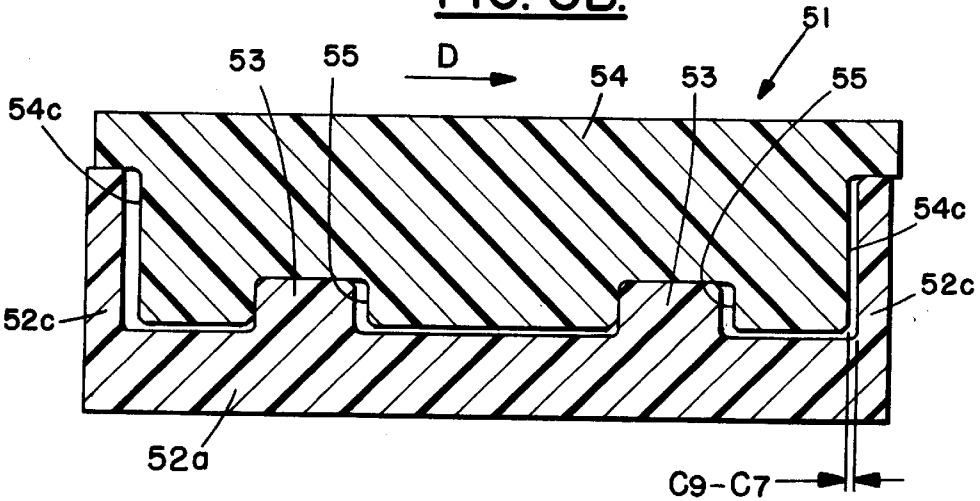
Figure 7A:
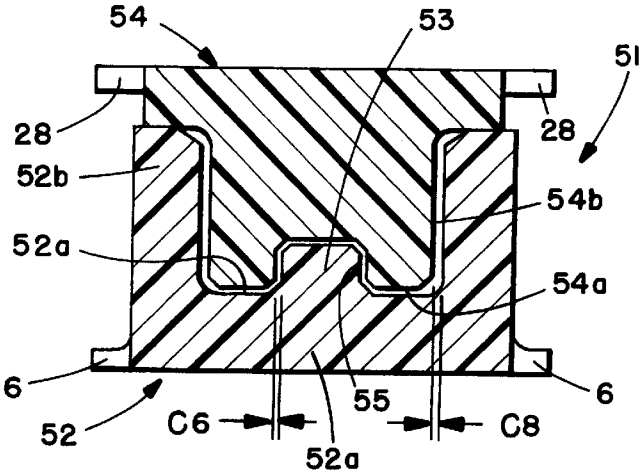
FIGS. 7A and 7B are vertical cross-sectional views taken along the transverse direction of the connector of FIG. 6.
Figure 7B:
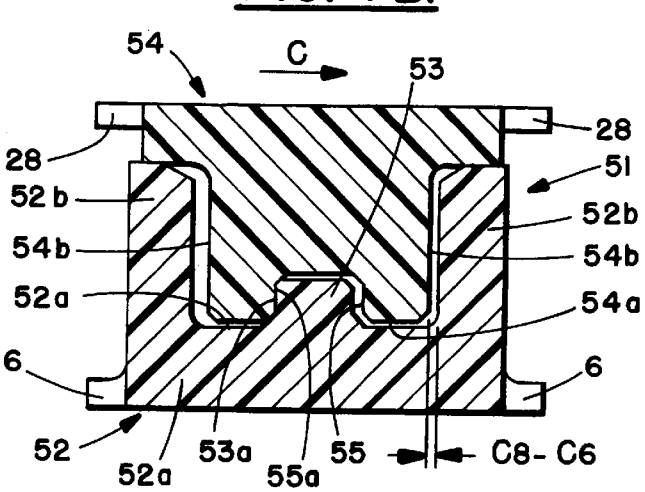

FIG. 6 is an angled view showing a state prior to the engagement of a connector 51 in accordance with the present embodiment, FIGS. 7A and 7B are vertical cross-sectional views along the transverse direction showing the state in which connector 51 in accordance with the present embodiment is engaged, and FIGS. 8A and 8B are vertical cross-sectional views along the longitudinal direction showing the state in which the connector 51 in accordance with the present embodiment is engaged.

In connector 51 in accordance with the present embodiment, a plurality of projecting parts 53 are provided in the floor surface 52*a* of receptacle housing 52 with gaps therebetween in the longitudinal direction of receptacle housing 52, and a plurality of concave parts 55 (see FIGS. 7A, 7B, and FIGS. 8A, and 8B) which engage these projecting parts 53 are formed in the lead end surface 54*a* of plug housing 54 which is in opposition to the projecting parts 53.

The projecting parts 53 are formed with a pillar shape having a rectangular horizontal cross section extending in the longitudinal direction and the transverse direction of receptacle housing 52. Furthermore, concave parts 55 have a shape which is rectangular in cross section and slightly larger than the horizontal cross-sectional shape of the projecting parts 53, so as to be capable of accepting projecting parts 53, as shown in FIGS. 7A, 7B, 8A, and 8B.

The dimensions c6 and c7 of the fitting gaps in the transverse and longitudinal directions between the projecting parts 53 and concave parts 55 are sufficiently smaller than the dimensions c8 and c9 of the fitting gaps in the transverse and longitudinal directions between the inner surfaces of the side walls 52*b* and 52*c* of the receptacle housing 52 and the side surfaces 54*b* and 54*c* of the plug housing 54, as shown in FIGS. 7A and 8A, and the design is similar with respect to the projecting parts 53.

Accordingly, when an impact force acts in the transverse direction on connector 51 (the direction shown by the arrow C in FIG. 7B), plug housing 54 moves within receptacle housing 52 in the manner shown in FIG. 7B with respect to receptacle housing 52; however, at this time, the side surface 53*a* of projecting parts 53 and the inner surface 55*a* of concave parts 55 are in contact, and a gap c8–c6 is maintained between the side wall 52*b* of receptacle housing 52 and the side surface 54*b* of plug housing 54. Accordingly, the impact force acting on the connector 51 is received by the projecting parts 53.

In this case, projecting parts 53 are provided in the floor surface 52*a* of a durable receptacle housing 52, so that the impact force is dispersed via the floor surface 52*a* of the receptacle housing 52. Moreover, it is possible to avoid the direct application of force to the side walls 52*b* of the receptacle housing 52, and during the attachment or detachment of connector 51, so long as plug housing 54 does not move laterally within the receptacle housing 52 to the point at which the gap c8–c6 disappears, it is possible to prevent damage to the opening end of receptacle housing 52 caused by the plug housing 54, so that, in the same manner as in the first through third embodiments above, it is possible to maintain the receptacle housing 52 in good condition.

In the same manner, even in the case in which an impact force acts in the longitudinal direction of connector 51 (the direction shown by the arrow D in FIG. 8B), plug housing 54 moves in the direction shown in FIG. 8B; however, the impact force is received by the contact between the projecting parts 53 and the concave parts 55.

In this manner, in accordance with the connector 51 of the present embodiment which adopts the structure in which projecting parts 53 are provided in the floor surface 52*a* of receptacle housing 52, an advantage is also presented in that it is possible to reduce the size of the projecting surface area of connector 51, that is to say, the installed surface area. Furthermore, the receptacle housing 52 and the plug housing 54 are positioned in a highly accurate manner by the fit between the plurality of projecting parts 53 and concave parts 55 disposed with gaps therebetween in the pitch direction of the contacts, so that it is possible to maintain the positioned state of the contacts even in a large number of connectors 51, and it is thus possible to avoid problems with contact slippages and the like.

In the fourth embodiment, projecting parts 53 were provided in the floor surface 52*a* of receptacle housing 52, and concave parts 55 were provided in the lead end surface 54*a* of the plug housing 54; however, this may be opposite, so that projecting parts 53 are provided in the lead end surface 54*a* of plug housing 54, while concave parts 55 are provided in the floor surface 52*a* of the receptacle housing 52. Furthermore, insofar as there is some excess in the dimensions, it is possible to structure the connector so that projecting parts 53 are provided in the inner surfaces of side walls 52*b* of receptacle housing 52 and concave parts 55 having groove shaped concave parts 55 which are capable of engaging the projecting parts 53 are provided in side surfaces 54*b* of plug housing 54, or by means of the opposite combination. In such cases, as well, the dimensions c7 of the fitting gap between the projecting parts 53 and the concave parts 55 in the transverse direction of the groove of projecting parts 55 should be set so as to be smaller than the dimensions c9 of the fitting gap between the side surfaces 54*b* of the plug housing 54 disposed on both sides of the transverse direction of the groove of concave parts 55 and the inner surfaces of the side walls 52*b* of the receptacle housing 52.

Furthermore, connectors may be constructed using an appropriate combination of the structures in accordance with the first through fourth embodiments above.

Furthermore, in the embodiment s described above, connectors having housings which were affixed to printed circuit boards were described; however, it is of course the case that the same operational effects may be obtained even in cases in which, in place of such boards, the housings are affixed to wiring elements comprising structures other than printed circuit boards.

Furthermore, even in cases in which the housings are not affixed to wiring elements, it is possible to employ the connectors of the embodiments described above in situations in which an external force is directly applied to the housings.

Figure 9:
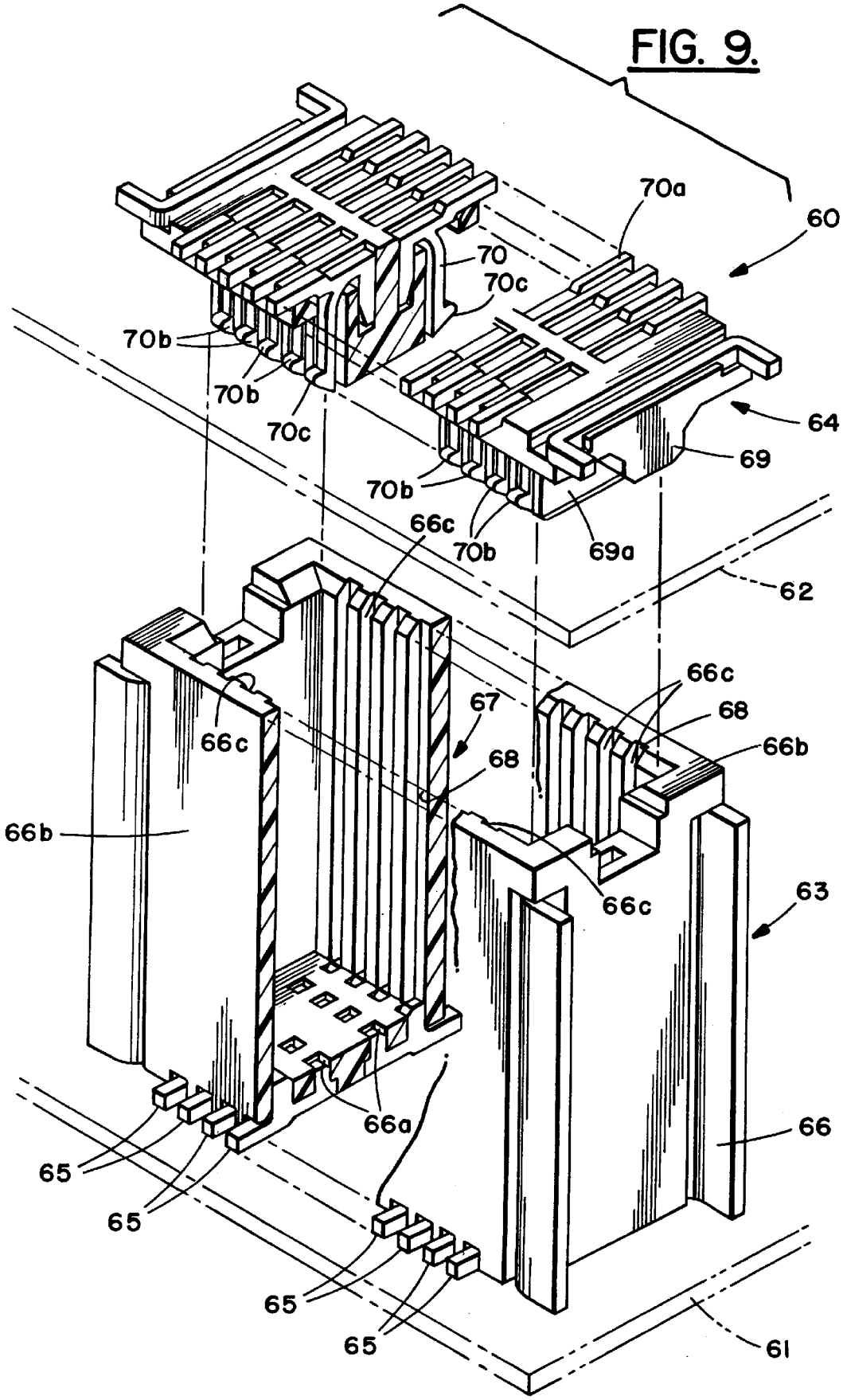
FIG. 9 is an angled view showing an embodiment of a connector in accordance with the present invention with a portion thereof cut away.

Next, a fifth embodiment of a connector in accordance with the present invention will be explained with reference to FIG. 9.

In the connector 60 in accordance with the present embodiment, for example, in a stacking connector 60 which is disposed between two printed circuit boards 61 and 62 as wiring elements, a first connector, such as a receptacle connector, which is attached to a printed circuit board 61, and a second connector, such as a plug connector, which is attached to another printed circuit board 62 are provided.

The first connector 63 is provided with a plurality of contacts 65 arranged in rows with parallel gaps therebetween, and with a housing 66 which houses the contacts 65 in this arranged state. The housing 66 has the shape of a box with a floor, and contacts 65 are attached using attachment holes 66*a* which are provided in the floor surface.

Furthermore, the side walls 66*b* of housing 66 are provided in an upright manner in a state in which they are perpendicular to the printed circuit board 61, and a plurality of grooves 66*c* which correspond to contacts 65 are formed in rows in the inner surfaces thereof.

Conductors 68 comprising metal leaf such as copper or the like are disposed in an affixed state at the floor surface of grooves 66*c* on the inner side of side walls 66*b* of housing 66. Each conductor 68 is connected to a contact 65 at the bottom end thereof in a conducting manner, either by soldering or by pressure contact.

These conductors 68 are formed with a thickness within a range of 10 micrometers–100 micrometers. Additionally, these conductors 68 are affixed to the floor surfaces of grooves 66*c* which are arranged in parallel rows, so that they are disposed in an adjacent manner in the transverse direction, and by means of this, the side surfaces, which are extremely thin, are disposed in a mutually opposed state.

Molded interconnection devices (MID) may be employed as a method for disposing conductors 68 comprising metal leaf in an affixed state within the housing 66 in this manner. MID forms a wiring pattern in a solid manner in a housing 66 formed by injection molding.

Furthermore, the upper end of this housing 66 is opened, and this is capable of engaging with the housing 69 of a second connector 64 described hereinafter at this opening. Additionally, during engagement, socket contacts 70 provided in the second connector 64 come into contact with the conductors 68 on the inner side of side walls 66*b* of housing 66 of the first connector 63. Accordingly, the conductors 68 of first connector 63 form pin contacts 67.

The second connector 64 comprises a plurality of socket contacts 70 which are disposed at a pitch identical to the row pitch of the contacts 65 of the first connector 63, and a housing 69 which maintains these contacts 70 in an integral manner. In the socket contacts 70, attachment parts 70*a*, which are affixed to the wiring (omitted in the figure) of the other printed circuit board 62 via soldering or the like, are disposed in an exposed manner at the floor surface of the housing 69, and exposed contact parts 70*b* are provided in the side surfaces of the engagement part of housing 69 which engages with the upper opening of housing 66 of the first connector 63.

The contact parts 70*b* of socket contacts 70 are provided in the form of cantilevered beams at attachment parts 70*a*, and these are capable of elastic deformation so that one side surface thereof may appear from the grooves provided in the side surface of the engaging parts 69*a* of housing 69. In the figure, reference 70*c* indicates a sloping guide surface for guiding the contact parts 70*b* of the socket contacts 70 so as to gradually elastically deform in the course of the engagement between the first connector 63 and the second connector 64.

Accordingly, the contact parts 70*b* of socket contacts 70 are disposed within a plurality of grooves 66*c* provided in the inner surface of side walls 66*b* of housing 66 of the first connector 63 when the engagement parts 69*a* of the housing 69 of the second connector 64 engage with the opening of the housing 66 of the first connector 63. Additionally, each contact part 70*b* is subjected to elastic deformation while one side surface thereof slides along a conductor 68 which is disposed in an affixed state in the floor of the groove 66*c*.

When the engagement between the first connector 63 and the second connector 64 is completed in this manner, the contact parts 70*b* of the socket contacts 70 are elastically deformed by a constant amount which is preset, and press against the conductors 68 with a preset amount of force, so that the appropriate conducting state is created. Moreover, the first connector 63 and the second connector 64 are coupled to one another in a positioned state by means of the engagement of housings 66 and 69, so that the printed circuit boards 61 and 62 which are affixed to the connectors 63 and 64 are also coupled in a positioned state.

In other words, in accordance with the connector 60 of the present embodiment, the height of the side walls 66*b* of the housing 66 of the first connector 63 occupies the greater part of the stacking height of the printed circuit boards 61 and 62, so that the stacking height is determined by the height of the side walls 66*b* of the housing 66. Additionally, if the stacking height sets the height of the side walls 66*b* of the housing 66 in accordance with the height of the other electronic parts which are installed on printed circuit boards 61 and 62, then it is possible to affix printed circuit boards 61 and 62 in a positioned state so that the other electronic parts do not come into contact with printed circuit boards 61 and 62, and it is possible to electrically connect the wiring of printed circuit boards 61 and 62 to one another.

In this case, as the height of the other electronic parts which are installed on printed circuit boards 61 and 62 increases, there are cases in which the height of the side walls 66*b* of housing 66 also increases in accordance with this. However, even in such cases, in accordance with the connector 60 of the present embodiment, the conductors 68 which are provided within housing 66 and which connect the wirings of printed circuit boards 61 and 62 to one another are formed with a thickness within a range of 10 micrometers–100 micrometers, and moreover, these are disposed so that the thin side surfaces are in mutual opposition, so that very little floating capacity is produced per unit length between two adjacent conductors 68.

Accordingly, in accordance with the connector 60 of the present embodiment, the cross-talk noise accompanying an increase in floating capacity is dramatically reduced, and even in cases in which the signal transmission speed is high, it is possible to transmit accurate signals.

Furthermore, with respect to the housing 66 which comprises a structural member, while the pitch of the contacts 65 affixed to the printed circuit board 61 is limited by the problem of the installed density, this can be set in a comparatively free manner using the space within printed circuit board 61, so that the pattern of the conductors 68 affixed to the housing 66 is also not limited by the pitch of the contacts 65 and may be freely set. As a result, it is possible to plan for the impedance matching of the circuit in the connector 60 part in a comparatively easy manner.

The connector in accordance with the present invention is not limited to the embodiments described above; a variety of modifications such as those shown below are possible.

Figure 10:
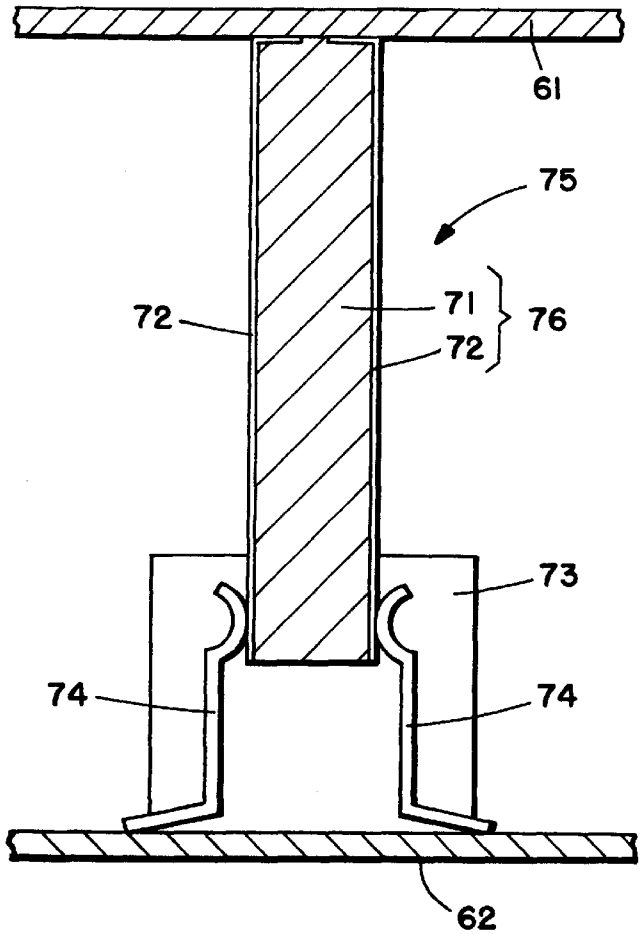
FIG. 10 is a vertical cross-sectional view showing a modification of the connector in accordance with the present invention.

In the embodiments described above, a first connector 63 such as a receptacle connector was provided on one printed circuit board 62, while a second connector 64 such as a plug connector was provided on the other printed circuit board 61, and the housing 66 of the first connector 63 comprised a MID; however, in place of this, as shown in FIG. 10 by connector 75, a pin contact 76 comprising a housing 71 with a conductor 72 attached thereto comprising a MID may be directly affixed to one printed circuit board 62, and the connector 72 may be connected by means of soldering to the wiring (not depicted in the figure) of the printed circuit board 61, and this may be engaged with a socket contact 74 of receptacle connector 73 affixed to the other printed circuit board 62.

Figure 11:
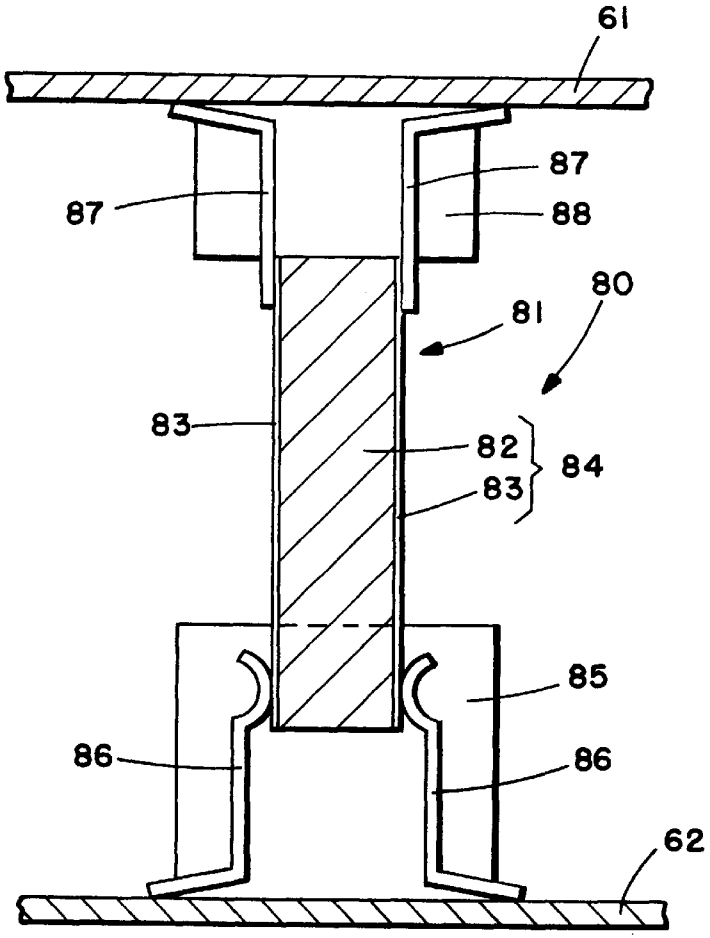
FIG. 11 is a vertical cross-sectional view showing another modification of the connector in accordance with the present invention.

Furthermore, in the manner of connector 80 shown in FIG. 11, a pin contact 84 constructed by affixing a leaf shape conductor 83 to the outer surface of a housing 82 provided on the side of a plug connector 81 affixed to one printed circuit board 61 may be engaged with a socket contact 86 of a receptacle connector 85 which is affixed to the other printed circuit board 62. Reference 87 indicates a contact, and reference 88 indicates a housing.

Figure 12:
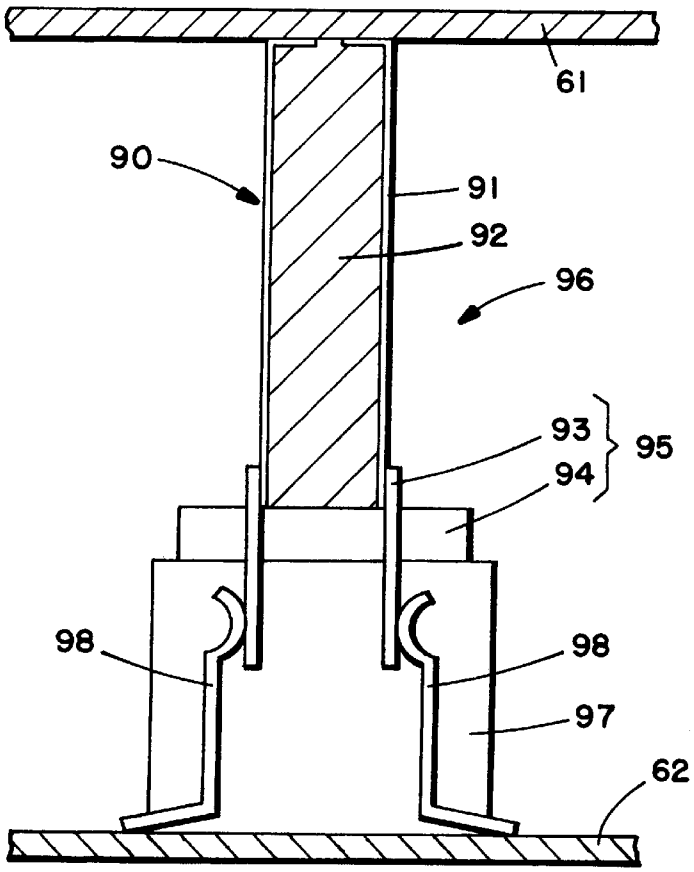
FIG. 12 is a vertical cross-sectional view showing another modification of the connector in accordance with the present invention.

Furthermore, a structure is possible such as that shown by connector 90 in FIG. 12, in which a housing 92 having a conductor 91 affixed thereto is affixed on printed circuit board 61, a connector 95, in which a pin contact 93 is housed within a housing 94, is affixed to the lead end of the housing 92, and this forms a plug connector 96, and this engages with a socket contact 98 of a receptacle connector 97 which is affixed to the other printed circuit board.

Figure 13:
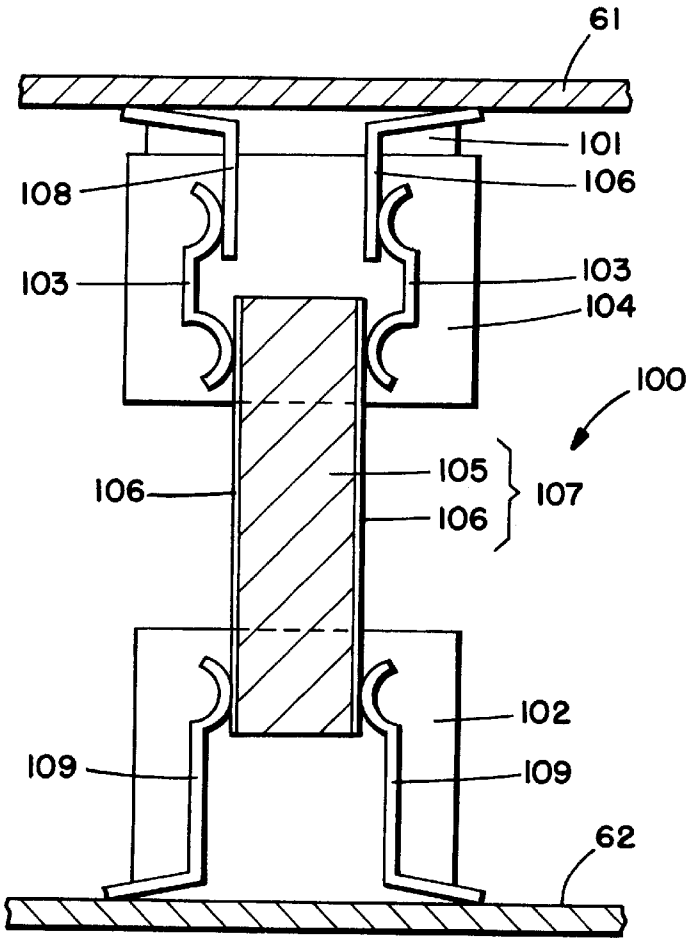
FIG. 13 is a vertical cross-sectional view showing another modification of the connector in accordance with the present invention.

Furthermore, a structure is also possible such as that shown by connector 100 shown in FIG. 13, in which a plug connector 101 is affixed to one printed circuit board 61, a receptacle connector 102 is affixed to another printed circuit board 62, and another receptacle connector 104, in which socket contacts 103 are disposed in both directions, is connected to the plug connector 101, and a conductor 106 on a housing 105 produced using a MID connects the receptacle connectors 102 and 104. References 107 and 108 indicate pin contacts, while reference 109 indicates a socket contact.

Figure 14:
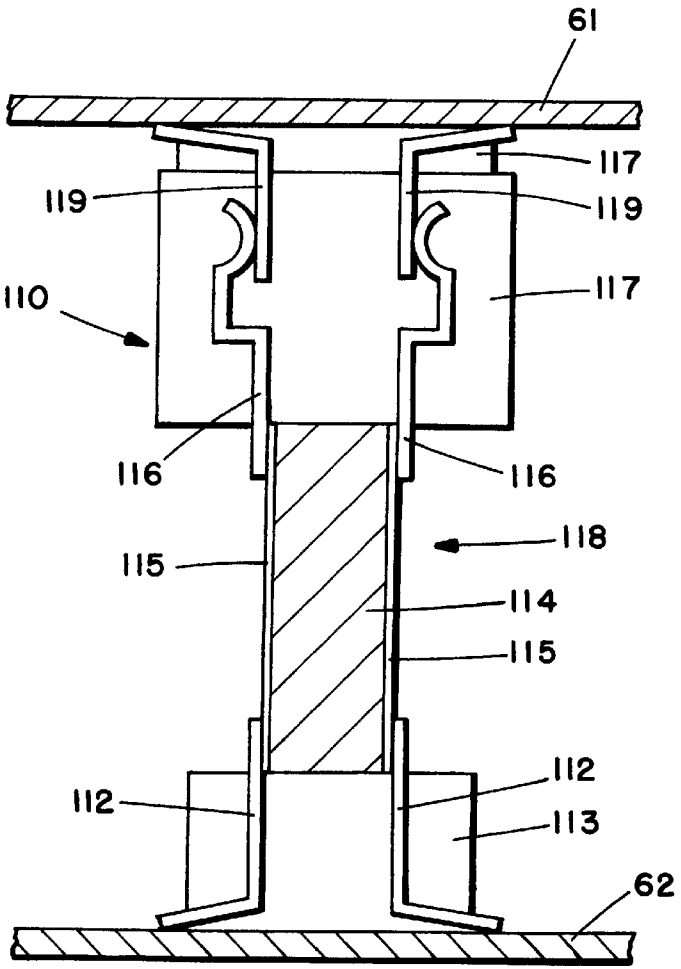
FIG. 14 is a vertical cross-sectional view showing another modification of the connector in accordance with the present invention.

Furthermore, a structure is also possible such as that shown by connector 110 in FIG. 14, in which a plug connector 111 is affixed to one printed circuit board 61, a housing 113 which houses contacts 112 is affixed to another printed circuit board 62, and a housing 114 constructed using a MID is attached to the housing 113 and the conductor 115 thereof and the contacts 112 are connected, while a housing 117, in which socket contacts 116 are housed, is affixed to the lead end of housing 114, forming a receptacle connector 118, which is engaged with the pin contacts 119 of the plug connector 111.

Figure 15:
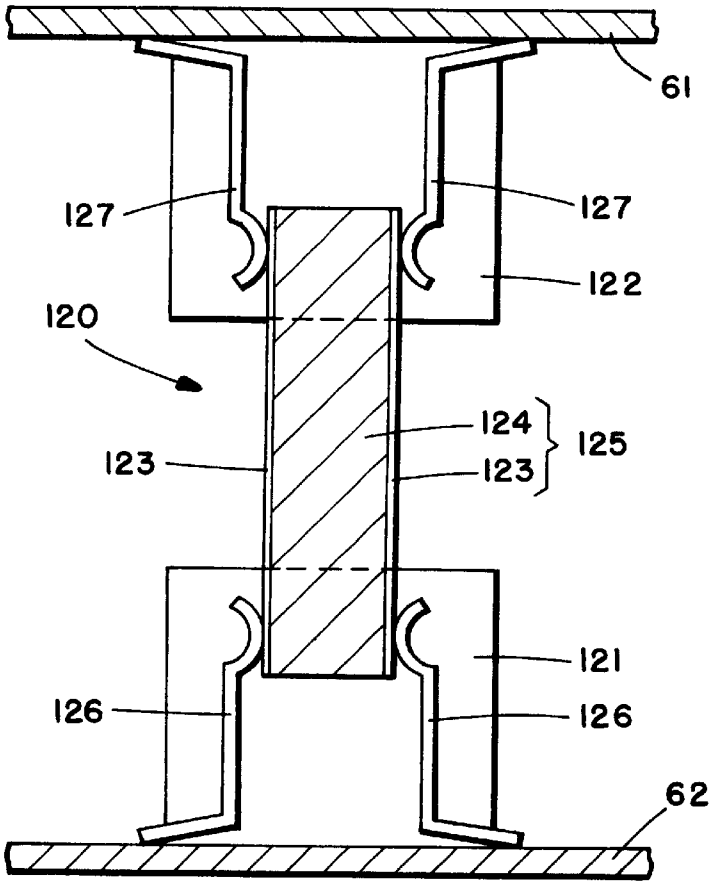
FIG. 15 is a vertical cross-sectional view showing another modification of the connector in accordance with the present invention.

Additionally, a structure is possible such as that shown by connector 120 in FIG. 15, in which receptacle connectors 121 and 122 are affixed to two printed circuit boards 61 and 62, a housing 124 having a conductor 123 constructed using a MID attached thereto is employed as pin contact 125, and the socket contacts 126 and 127 of the receptacle connectors 121 and 122 are thereby connected.

Figure 16:
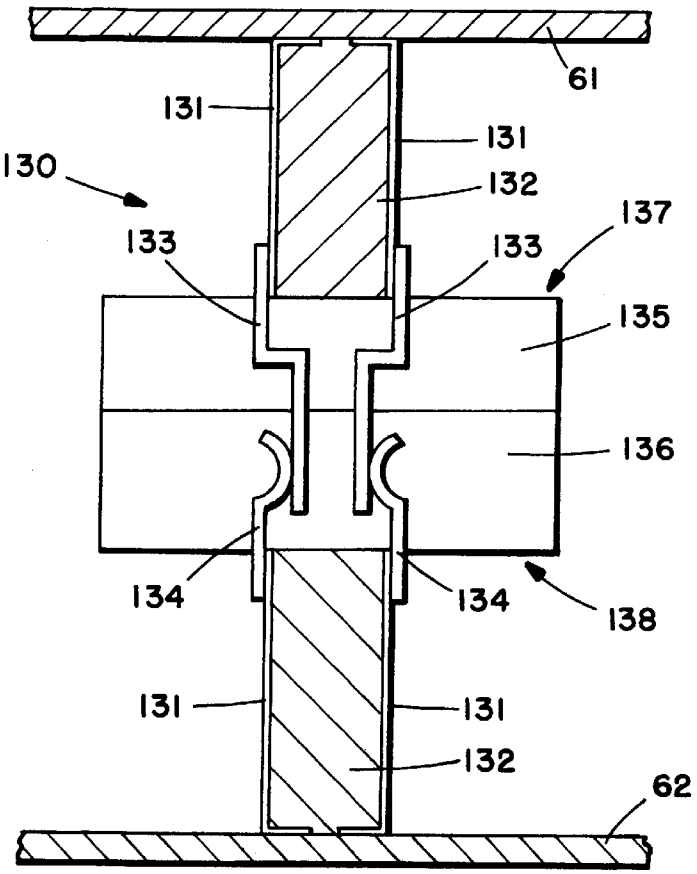
FIG. 16 is a vertical cross-sectional view showing another modification of the connector in accordance with the present invention.
Figure 20:
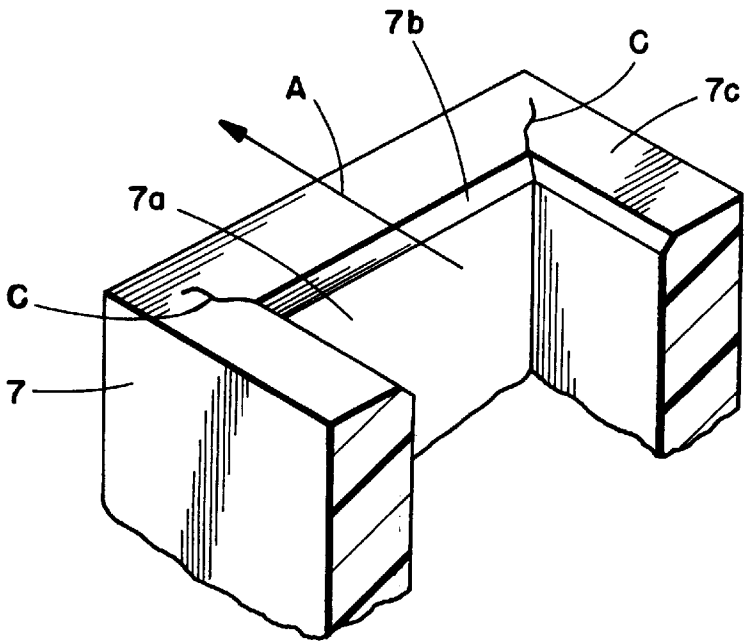
FIG. 20 is an angled view showing a portion of the opening part of the receptacle housing of the connector of FIG. 19.

Furthermore, a structure is also possible such as that shown by connector 130 in FIG. 16, in which housings 132 having conductors 131 constructed using MIDs attached thereto are affixed to two printed circuit boards 61 and 62, and by attaching housings 135 and 136 containing pin contacts 133 or socket contacts 134 to the lead ends thereof, a plug connector 137 and a receptacle connector 138 having this structure are caused to engage.

Figure 17:
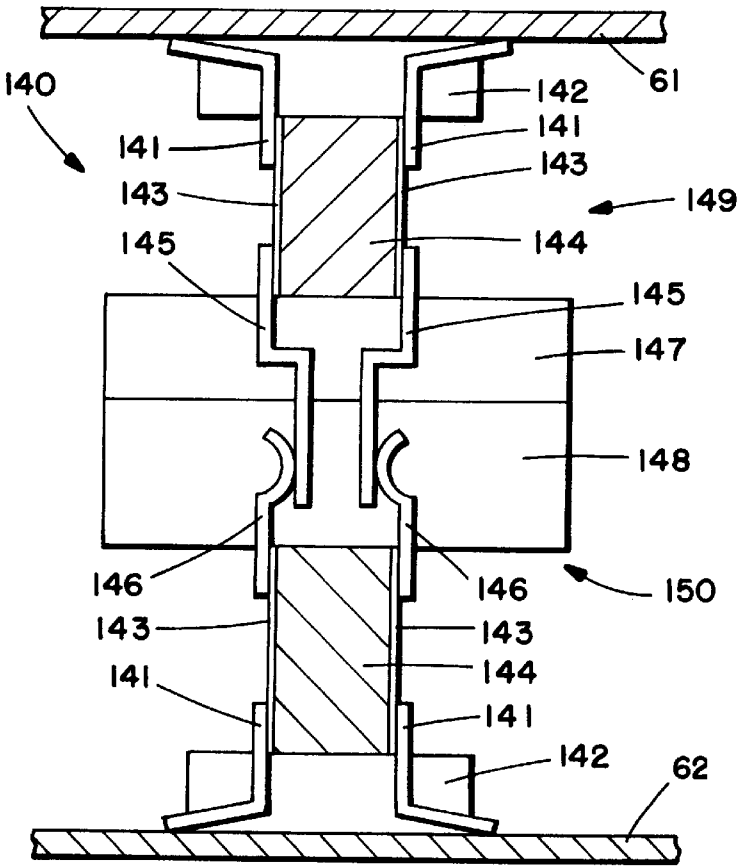
FIG. 17 is a vertical cross-sectional view showing another modification of the connector in accordance with the present invention.

Furthermore, a structure is also possible such as that shown by connector 140 in FIG. 17, in which engagement is brought about between a plug connector 149 and receptacle connector 150 which are structured by means of affixing housings 142 containing contacts 141 to printed circuit boards 61 and 62, housings 144 having conductors 143 comprising MIDs attached thereto are affixed to the housings 142 and thereby the conductors 143 are connected with the contacts 141, and furthermore, housings 147 and 148 containing either pin contacts 145 or socket contacts 146 are attached to the lead ends of the housings 144.

Figure 18:
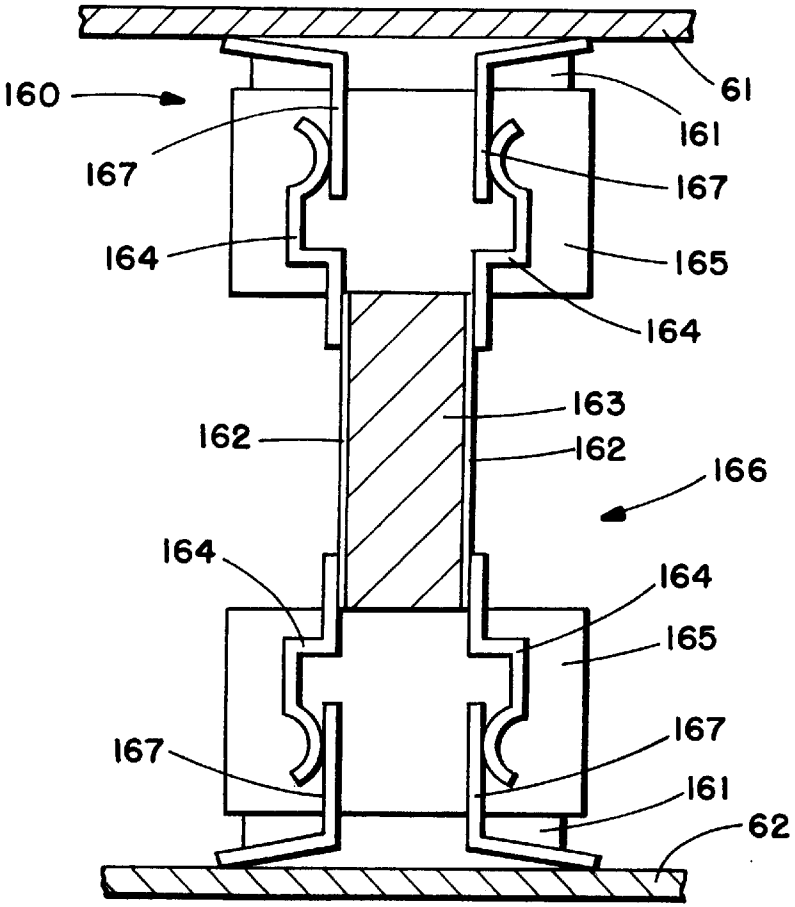
PRIOR ART FIG. 18.
FIG. 18 is a vertical cross-sectional view showing another modification of the connector in accordance with the present invention.
Figure 19:
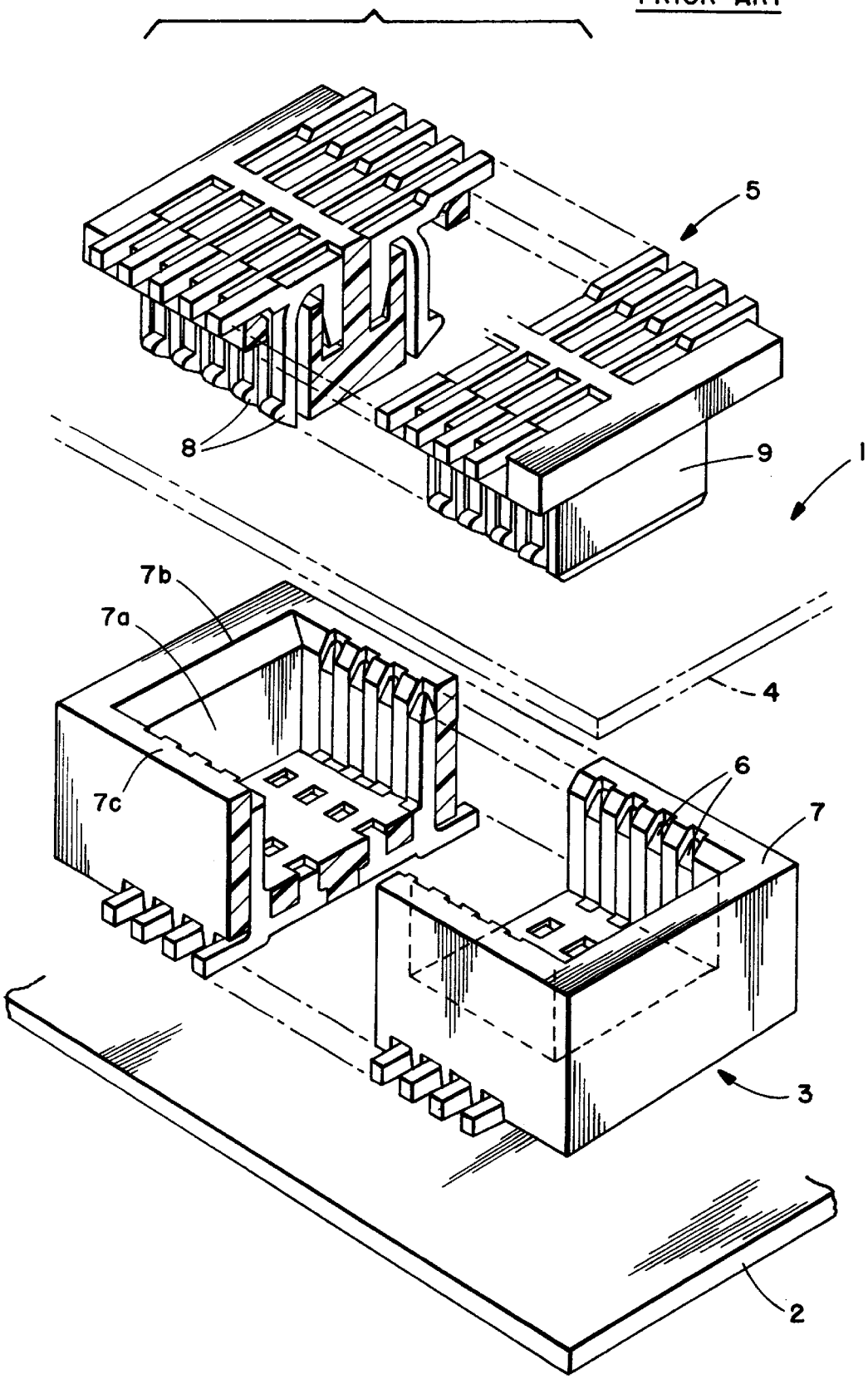
FIG. 19. PRIOR ART
FIG. 19 is an angled view showing an example of a conventional connector.
Figure 21:
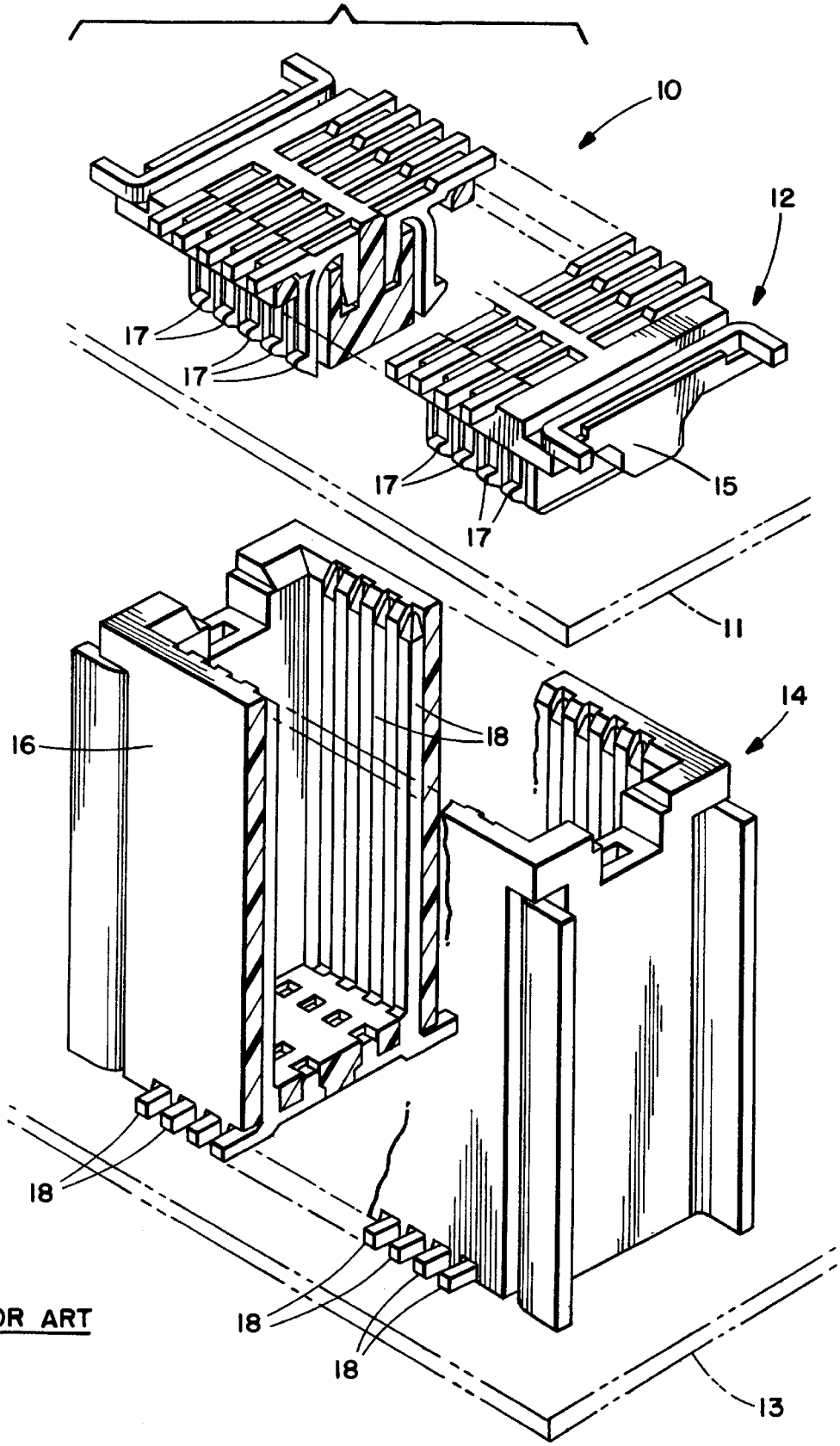
FIG. 21 is an angled view showing a conventional example of a stacking connector with a portion thereof cut away.

Furthermore, a structure is also possible such as that shown by connector 160 in FIG. 18, in which plug connectors 161 are fixed to printed circuit boards 61 and 62, and the coupling of plug connectors 161 to one another is brought about by receptacle connectors 166 which are constructed by attaching housings 165 containing socket contacts 164 to both ends of a housing 163 having a conductor 162 comprising a MID attached thereto. Reference 167 indicates a pin contact.

Furthermore, in the embodiments described above, the housings 66, 71, 82, 92, 105, 114, 124, 132, 144, and 163 to which were affixed the leaf form conductors 68, 72, 83, 91, 106, 115, 123, 131, 143, and 162, were constructed using MIDs; however, in place of this, printed circuit boards may employed. In such a case, connection may be accomplished by engaging the terminal, provided on both ends of the printed circuit board used for connection, with the receptacle connector provided on printed circuit boards 61 and 62.

Furthermore, in addition to the MIDs and printed circuit boards described above, flexible printed circuit boards may be used in freely selected structures, for example, by applying these in plate form, and the effects of the embodiments described above will be unchanged.

What is claimed is:

1. A connector for connecting two wiring elements, the connector being locatable in a gap between the two wiring elements and electrically connect wirings on the wiring elements to each other, the connector comprising:

a receptacle housing having a shape of a box with a floor, the receptacle housing being affixed to a first one of the wiring elements and which houses a plurality of first contacts connected to the wiring of the first wiring element; and a plug housing affixed to a second one of the wiring elements and which houses a plurality of second contacts connected to the wiring of the second wiring element, the plug housing being engaged within the receptacle housing during connection of the housings to each other;

wherein at least one of the housings comprises projecting parts which project in a direction of the other housing during connection of the housings to each other, the projecting parts being provided in at least one of an inner surface of the receptacle housing or an outer surface of the plug housing proximate the floor of the receptacle housing, and wherein dimensions of a first fitting gap between the housings at the projecting parts is set so as to be smaller than the dimensions of a second fitting gap between the housings at a location other than the projecting parts.

2. A connector in accordance with claim 1, wherein the projecting parts are provided in the inner surface of a side wall of the receptacle housing or in a side surface of the plug housing.

3. A connector in accordance with claim 2, wherein groove shaped concave parts, which engage the projecting parts, are formed in the other housing opposed to the projecting parts, and a depth of the concave parts is set so as to be smaller than a height of the projecting parts.

4. A connector in accordance with claim 3, wherein the dimensions of the first fitting gap between the concave parts and the projecting parts, in a transverse direction of a groove of the groove shaped concave parts, is set so as to be smaller than the dimensions of the second fitting gap between both housings disposed on both sides in the transverse direction of the groove.

5. A connector in accordance with claim 1, wherein the projecting parts are provided in a floor surface of the housing or a lead end surface of the plug housing, and concave parts which engage the projecting parts are formed in the lead end surface of the plug housing or in the floor surface of the receptacle housing opposed to the projecting parts; respectively.

6. A connector in accordance with claim 1, wherein a guide concave part, having a larger fitting gap with the plug housing, is provided in a vicinity of an opening end of an inner surface of side walls of the receptacle housing.

7. A connector comprising:

a receptacle housing having a shape of a box with a floor; and a plug housing which is engaged with the receptacle housing, wherein at least one of the housings comprises projecting parts which project in a direction of the other housing proximate the floor of the receptacle housing during engagement of the housings, the projecting parts being provided in at least one of an inner surface of the receptacle housing or an outer surface of the plug housing, and wherein dimensions of a first gap between the two housings at the projecting parts is set so as to be smaller than dimensions of a second fitting gap between the two housing at a location other than the projecting parts.

8. A connector in accordance with claim 1, wherein the first contacts connected to the wiring of the first wiring element are pin contacts, and the second contacts connected to the wiring of the second wiring element are socket contacts capable of being attached to and detached from the pin contacts, and wherein conductors, which are formed in a leaf form and applied to surfaces of structural parts and which are disposed in an adjoining manner in a transverse direction, are connected to at least one of the pin contacts and the socket contacts.

9. A connector, which is disposed between two wiring elements disposed with a gap therebetween, and which couples the wiring elements and detachably connects a plurality of corresponding wirings provided on the wiring elements, wherein pin contacts and socket contacts, which are attachable to and detachable from each other, are provided to the corresponding wirings of the two wiring elements, and conductors, formed with a leaf form and applied to surfaces of structural parts and which are disposed in an adjoining manner in a transverse direction, are connected to at least one of the pin contacts and the socket contacts, wherein the connector further comprises a first connector in which a plurality of the pin contacts connected to the wiring of a first one of the wiring elements are maintained in a first housing, and a second connector in which a plurality of the socket contacts connected to the wiring of a second one of the wiring elements are maintained in a second housing, and wherein the structural parts comprise at least one of the housings.

10. A connector in accordance with claim 9, wherein the structural parts to which the conductors are affixed comprise a printed circuit board.

11. A connector in accordance with claim 9, wherein the structural parts to which the conductors are affixed comprise a molded interconnection device (MID).

12. A connector in accordance with claim 9, wherein the conductors affixed to the structural parts comprise flexible printed circuit board conductors.

13. A connector in accordance with claim 9, wherein the conductors affixed to the structural parts comprise pin contacts.

* * * * *